United States Patent [19]

Lebelle

[11] 4,050,527

[45] Sept. 27, 1977

[54] VIBRODRIVER APPARATUS

[76] Inventor: Jean L. Lebelle, 92210 Saint Cloud, France

[21] Appl. No.: 676,507

[22] Filed: Apr. 13, 1976

[30] Foreign Application Priority Data

Apr. 23, 1975 France ..... 75.12622

[51] Int. Cl.[2] ..... E02D 7/18

[52] U.S. Cl. ..... 173/49; 74/61

[58] Field of Search ..... 37/DIG. 18; 61/53.5; 74/61, 87; 173/49; 175/55; 259/DIG. 42; 299/14

[56] References Cited

U.S. PATENT DOCUMENTS

| | | | |
|---|---|---|---|
| 2,897,734 | 8/1959 | Bodine | 173/49 X |
| 3,280,924 | 10/1966 | Pavlovich | 173/49 X |
| 3,368,632 | 2/1968 | Lebelle | 173/49 |

FOREIGN PATENT DOCUMENTS

| | | | |
|---|---|---|---|
| 809,485 | 12/1936 | France | 173/49 |
| 185,670 | 2/1967 | U.S.S.R. | 173/49 |

*Primary Examiner*—Lawrence J. Staab
*Attorney, Agent, or Firm*—Kirschstein, Kirschstein, Ottinger & Frank

[57] ABSTRACT

An improved vibrodriver for sinking a vertically elongated element of substantially uniform horizontal cross-section into or extracting such an element from the ground. The element is one of a plurality of like elements arranged side-by-side along a straight or curved line. The vibrodriver includes at least one pair of eccentrics with each eccentric or a portion thereof situated on a different side of the element. The vibrodriver has a waist which is narrower than the width of an element along the line; beyond the waist and toward its lateral ends the vibrodriver has at least one portion of each side thereof which is wider than the width of an element, thereby enabling the vibrodriver to be of relatively short horizontal length perpendicular to said line and yet to exert a substantial vertical vibratory force during the sinking or extraction of an element juxtaposed to at least one other element.

8 Claims, 18 Drawing Figures

Fig. 6 Prior Art
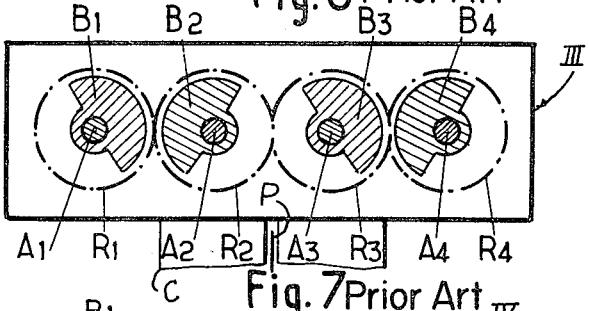
Fig. 7 Prior Art
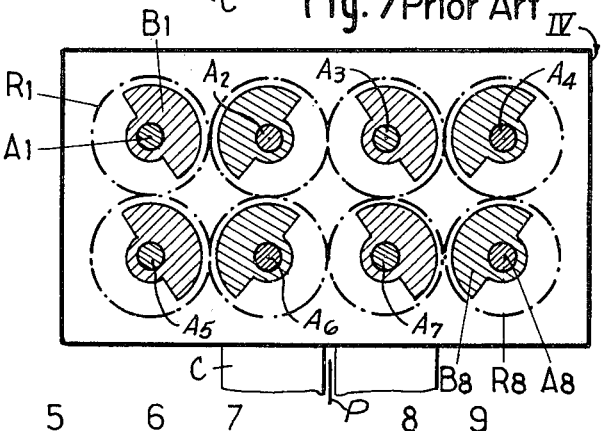
Fig. 8 Prior Art
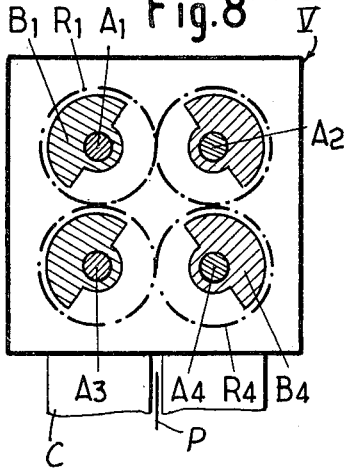
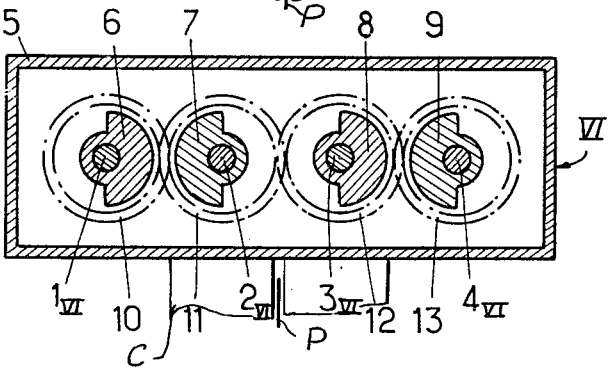
Fig. 9
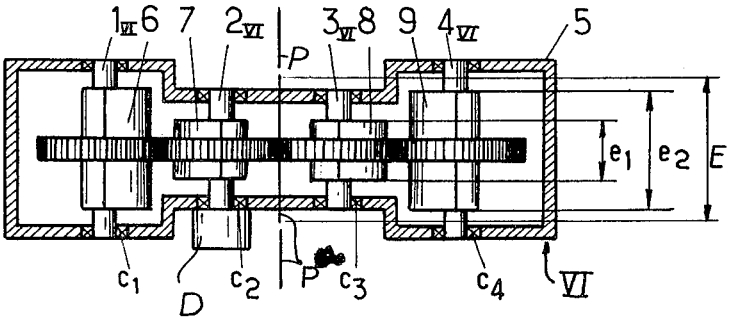
Fig. 10

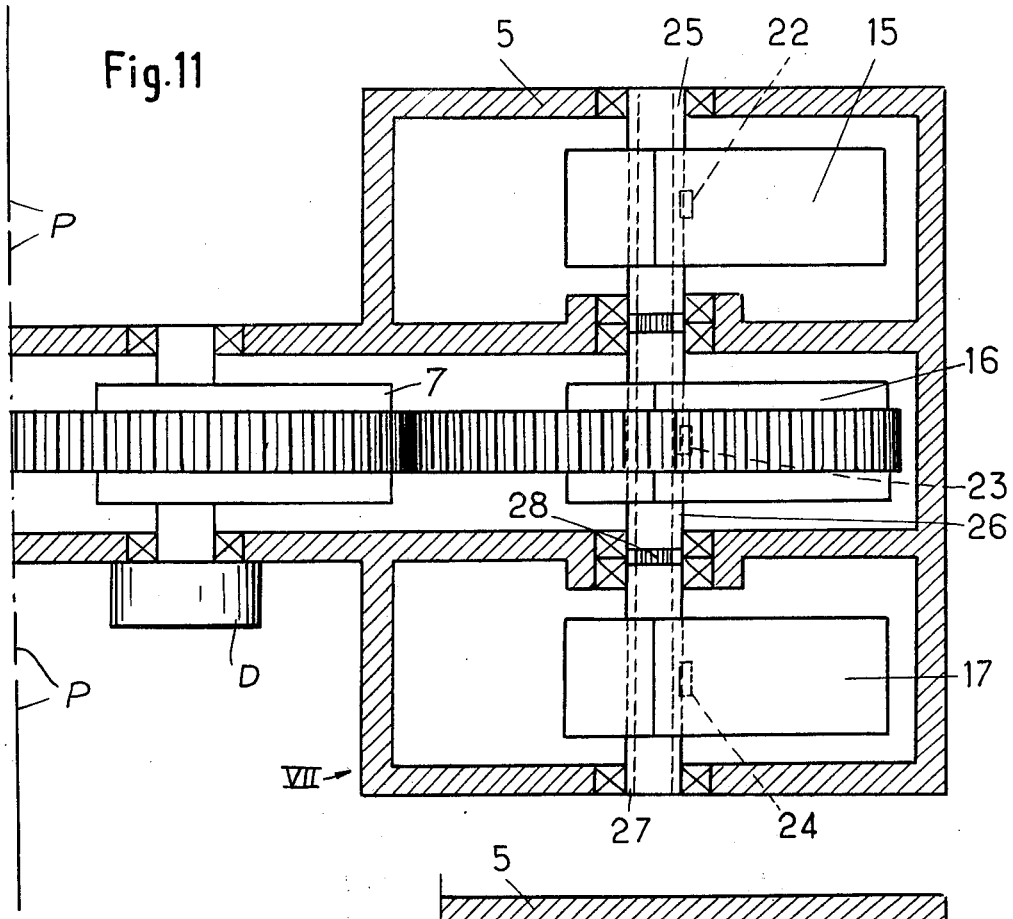
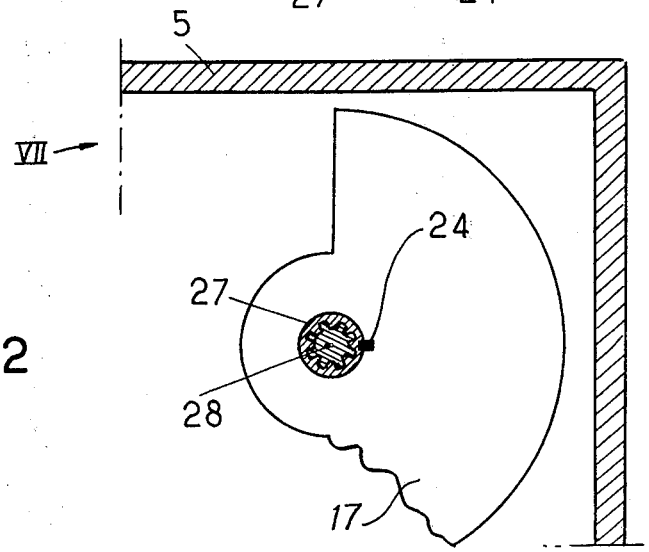
Fig.12

D
VIII
P
C 38
39
30
D
31
29
C
32
37
P
C
33
34
35
36
41
VIII
40

VIBRODRIVER APPARATUS

BACKGROUND OF THE INVENTION

1. Field of the Invention

The invention relates to the type of apparatus for driving an element into the ground, or extracting an element from the ground, which is commonly termed a vibrodriver, and in which vertical vibratory or vibro-percussive forces generated by rotating eccentrics are employed to emplace or displace the element.

2. Description of the Prior Art

Vibrodriver apparatus improvements are described in U.S. Pat. Nos. 3,564,932; 3,433,311; 3,394,766; 3,391,435 and 3,368,632. The vibrodriver technique has found wide applicability in the emplacing of elements such as sheet-piles, pilings, beams, tubes, pipes, rods, or the like in the ground, as well as in the stabilization or compaction of soil as described in U.S. Pat. No. 3,621,659. Within the context of the present invention, the term vibrodriver, entailing the usage of vertical vibratory forces, will be understood to encompass and include the usage of the vibro-percussive force or mode as described in U.S. Pat. No. 3,394,766.

Vibrodrivers generate a unilinear vibration, usually vertical, for sinking, e.g. into the ground, an element such as mentioned supra, or for facilitating the extraction of such an element. Vibrodrivers include one or many pairs of identical eccentrics rotating in synchronism on opposite sides of the associated element. Heretofore, to increase the vibratory force, a vibrodriver, being constrained in configuration by the width of the element to which it was clamped, has had to be either increased in height or breadth, or both, in order to provide space for larger or more eccentrics. Such increases were undesirable but have been accepted. An increse in width has been barred because the vibrodriver would strike against or be blocked by the two elements sited on both sides of the element to be handled. This consideration applied generally to any arrangement of juxtaposed elements, e.g. a seriatim arrangement wherein the elements jointly form a straight or curved line. The same problem applies to the extraction of an element in a line of elements.

SUMMARY OF THE INVENTION

Purposes of the Invention

It is an object of the present invention to provide an improved vibrodriver.

Another object is to provide a vibrodriver the width of which exceeds the width of the element to which it is clamped.

A further object is to provide a wide vibrodriver which can handle a narrow element which is one of a plurality of juxtaposed elements, while yet providing a high moment of eccentricity.

An additional object is to provide an improved configuration and arrangement of eccentrics for vibrodrivers.

Still another object is to facilitate the emplacing or withdrawing of an element from a mass such as the ground in instances where a limited clearance, i.e. a maximum linear horizontal dimension, exists for the mounting of a vibrodriver on the element.

These and other objects and advantages of the present invention will become evident from the description which follows.

Brief Description of the Invention

A vibrodriver of unique configuration is provided for utilization in instances where the element to be displaced, e.g. sunk into or extracted from the ground, is one of many juxtaposed along a line and is of a given maximum linear horizontal dimension (width). Typically this dimension will be the spacing between two elements on opposite sides of the element to be displaced. The elements will be arranged seriatim, in a straight or curved line. Other applicability of the apparatus would be where the location of the element to be emplaced or extracted is confined, e.g. by natural rock formations.

The present vibrodriver is characterized by a waist which is narrower than the width of an element on a line of such elements and by greater widths outwardly beyond the waist in order to accommodate rotating eccentrics wider than the waist and, usually, wider than the element, so that a greater unilinear vibratory force can be obtained without unduly increasing the height or breadth of the vibrodriver.

The new configuration of vibrodriver eccentrics is basically attained by either of two alternative arrangements, depending on the disposal of the horizontal axes of rotation of the eccentrics relative to the width of the element. When the axes of rotation of the eccentrics are parallel to the width of the element, the lengths of eccentrics outwardly beyond the waist will exceed the width of the waist, plural coaxial eccentrics being deemed to be a single eccentric. When the axes of rotation of the eccentrics are perpendicular to the width of the element, the radii of eccentrics outwardly beyond the waist will exceed the width of the waist. In both arrangements the involved dimensions of the eccentrics usually will exceed the width of the element.

The invention is based on the appreciation that, at a short distance laterally outwardly from a line of juxtaposed elements, the width of the vibrodriver no longer is limited by the effective width of an element, i.e., the maximum linear horizontal dimension between the two elements on opposite sides of the element being displaced.

A vibrodriver according to the present invention frequently will employ several pairs of eccentrics. It is distinguished from the prior art by the fact that the eccentrics or the eccentric parts disposed laterally outwardly of a narrow waist have dimensions parallel to the width of an element greater than the aforesaid maximum linear horizontal dimension.

According to the first above mentioned arrangement in which the horizontal axes of rotation of the eccentrics are parallel to the width of an element, at least one pair of eccentrics laterally beyond the waist are longer than the waist. A preferred configuration is one in which each outer eccentric for a pair is composed of several coaxial eccentrics the conjoint length of which exceeds the width of the waist. These several eccentrics are connected for common rotation.

In the other arrangement in which the horizontal axes of rotation of the eccentrics are perpendicular to the width of an element, at least one pair of eccentrics or portions thereof laterally beyond the waist have radii that exceed the width of the vibrodriver narrow waist.

The present invention provides several salient advantages. A large moment of eccentricity is obtained, without solely increasing the height or breadth of the vibrodriver, or both. An element with any effective width, even quite small, may be successfully sunk or extracted. This consideration is especially important when the element is one of a plurality of elements arranged in linear juxtaposition to form a wall.

The invention accordingly consists in the features of construction, combinations of elements and arrangements of parts which will be exemplified in the vibrodrivers hereinafter described and of which the scope of application will be indicated in the appended claims.

BRIEF DESCRIPTION OF THE DRAWINGS

Referring now to the drawings,

FIGS. 6, 7, and 8 are schematic vertical sectional views of three different forms of the first type of vibrodriver, illustrating various modes of increasing eccentric moment that have been utilized in the prior art and which enlarged the height and/or breadth of the vibrodriver without obtaining the further increase in eccentric moment that results from use of the present invention;

FIGS. 9 and 10 are schematic views in vertical and horizontal section, respectively, of the first type of vibrodriver embodying the invention;

FIGS. 11 and 12 are schematic fragmentary views in vertical and horizontal section, respectively, showing details of a preferred variation of the vibrodriver illustrated in FIGS. 9 and 10;

DETAILED DESCRIPTION OF THE PREFERRED EMBODIMENTS

Figure 1:
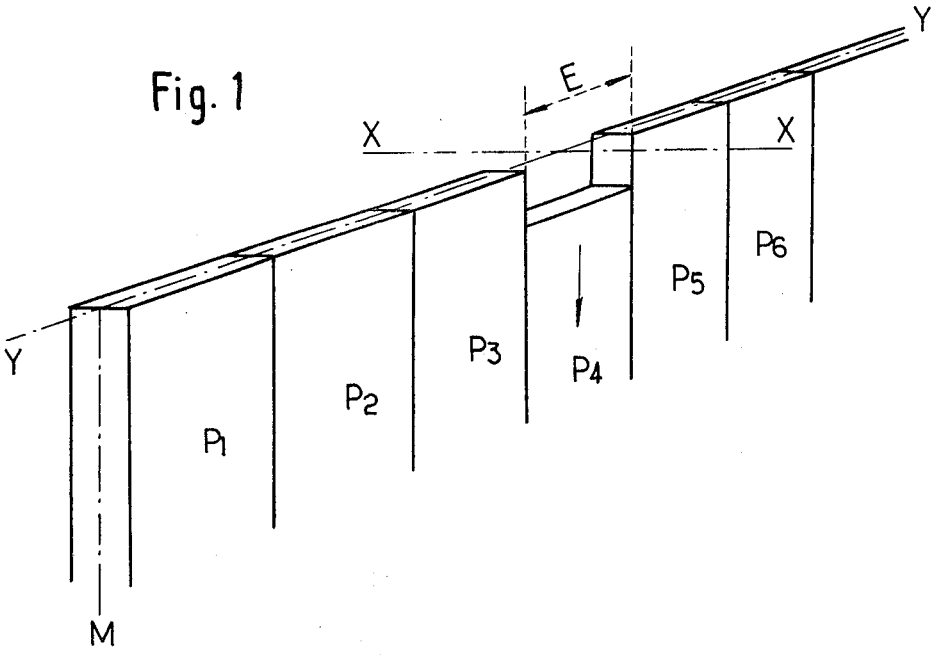
FIG. 1 is a perspective schematic view of the upper ends of a line of juxtaposed elements the lower ends of which have been sunk into the ground and one of which is deeper than the others to illustrate the problem that has been solved by the invention.

Referring now to FIG. 1, a line of vertically elongated juxtaposed elements of substantially uniform horizontal cross-section is shown, the elements being exemplicatively in the form of schematically represented sheet-piles $P_1$, $P_2$, $P_3$, $P_4$, $P_5$, $P_6$, of width E; the line of elements effectively constitutes a wall. As mentioned supra, the width E is the maximum linear horizontal dimension between two sheet-piles on opposite sides of a given sheet-pile, this best being shown with respect to the sheet-pile $P_4$. Although the sheet-piles are generally non-rectangular in practice, being provided with a transverse cross-section which is profiled in a corrugated or other non-linear fashion in order to secure better strength and interengagement (see FIG. 14 for instance), the sheet-piles of FIG. 1 are represented as simple rectangular elements, the only purpose of FIG. 1 being to show clearly the different directions and geometric arrangements necessary to the description of the invention. The problem solved by the invention is the sinking or extraction of a sheet-pile $P_4$ for instance, lower than an adjacent sheet-pile $P_3$ and/or $P_5$ at opposite sides of the sheet-pile $P_4$.

Within the context of the present invention the following definitions apply: the vibrodriver width is its horizontal dimension in the direction Y parallel to the line of elements, the vibrodriver breadth is its other horizontal dimension in the direction X perpendicular to the line of elements, the vibrodriver height is its vertical dimension in the direction M parallel to lengths of the sheet-piles. For reference, it has been assumed, for the above definitions, that the sheet piles are vertical.

Vibrodrivers usually are of one of two structural arrangements (types). In the first, there are one or more pairs of eccentrics that rotate about horizontal axes parallel to the width of the vibrodriver and parallel to the plane MY. In the second, there are one or more pairs of eccentrics that rotate about horizontal axes parallel to the breadth of the vibrodriver and perpendicular to the plane MY. In the first arrangement the eccentrics of each pair are on opposite sides of the plane MY of the element being displaced. In the second arrangement the eccentrics of each pair effectively extend through the plane MY, in some cases physically extending through the plane and in other cases being coaxial, with the common axes extending through the plane and the eccentrics being physically located on opposite sides of the plane.

The foregoing best can be explained by reference to FIGS. 2 through 5 which illustrate both arrangements of prior art vibrodrivers.

Figure 2:
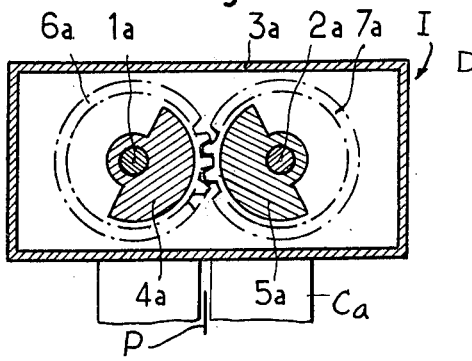
Fig. 2 Prior Art
FIGS. 2 and 3 are schematic views in vertical and horizontal section, respectively, of a first type of prior art vibrodriver to which the improvement according to the present invention can be applied.
Figure 3:
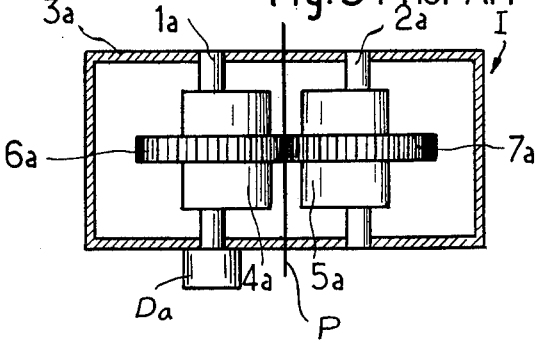
Fig. 3 Prior Art

A prior art vibrodriver I of the simplest structure embodying the first arrangement is shown in FIGS. 2 and 3. It includes a housing, i.e. chassis, 3*a* in which are housed a pair of eccentrics 4*a*, 5*a* having horizontal axes of rotation 1*a* and 2*a*, respectively. Gears 6*a* and 7*a*, respectively fixed to the eccentrics 4*a* and 5*a*, are in direct mesh so that the eccentrics rotate in opposite directions. The chassis is releaseably secured to the upper end of a sheet-pile P to be displaced by a conventional clamp $C_a$. The eccentrics are situated on opposite sides of the plane MY of the sheet-pile, the axes of rotation 1*a* and 2*a* being horizontal and parallel to said plane. The eccentrics are spun by a driver motor $D_a$. The relative angular orientation of the eccentrics is such that their centers of mass at a point in each 360° of revolution are directly above their axes of rotation and at a point 180° displaced therefrom are directly below their axes of rotation. The eccentrics are in transverse registry, have identical weights and configurations and their centers of mass have identical radial spacings from their respective axes of rotation. Hence, as is well known, when the driver motor is energized, the lateral vibratory forces developed by each of the two eccentrics of a pair are equal and opposite so that the net lateral vibratory force is effectively zero. However, the vertical vibratory forces developed by each of the two eccentrics of a pair are equal and additive whereby a net vertical (unilinear) vibratory force is generated that is double the vertical vibratory force of each eccentric.

This vertical net vibratory force is sinusoidal, reaching a maximum upward value when the centers of mass of the eccentrics are uppermost and a maximum downward value when the centers of mass are lowermost.

Figure 4:
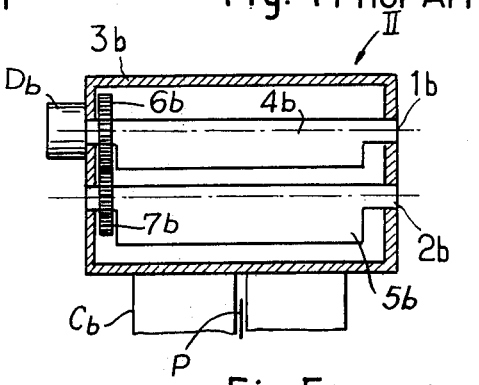
Fig. 4 Prior Art
FIGS. 4 and 5 are views similar to FIGS. 2 and 3, respectively, of a second type of prior art vibrodriver which, likewise, can be improved by application of the present invention.
Figure 5:
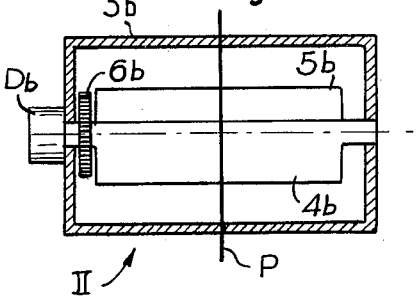
Fig. 5 Prior Art

A prior art vibrodriver II of the simplest structure embodying the second arrangement is shown in FIGS. 4 and 5 where the same reference numerals and letters denote the same or equivalent parts, being distinguished therefrom by the use of the subscript *b* for the vibrodriver II in place of the subscript *a* for the vibrodriver I. The eccentrics 4*b* and 5*b* are in vertical registry, and their axes of rotation are horizontal and are perpendicular to and extend through the plane MY of the sheet-pile P to which the vibrodriver is releaseably secured by a clamp $C_b$. The eccentrics are spun by a driver motor $D_b$, being coupled for opposite rotation by meshing gears 6*b* and 7*b* fixed thereto. The relative angular orientation of the eccentrics are such that their centers of mass are in identical positions only at the tops and bottoms of their travel. The weights, configurations and sitings of the centers of mass relative to their respective axes of rotation are identical for both eccentrics so that an effectively nil net transverse vibratory force but a substantial net sinusoidal unilinear vertical vibratory force is generated when the driver motor $D_b$ is energized.

When vibrodrivers were used to sink or extract a single sheet-pile, e.g. $P_4$, between two others, either or both of which already were in place, vibrodriver widths across and adjacent the plane MY of the sheet-piles, and, correspondingly, across and adjacent the central plane of symmetry of the vibrodriver (coincident with the plane MY) invariably were smaller than the width E of the clamped sheet-pile (the maximum linear horizontal dimension) to prevent interference between the vibrodriver and the adjacent sheet-piles This, heretofore, has been considered an absolute limiting factor over the entire breadth of prior art vibrodrivers.

Frequently the small eccentric moments of the simple arrangements of the vibrodrivers I and II are insufficient to sink or extract a pile under existing conditions. The unilinear vibratory force can be increased by increasing the speed of rotation of the eccentrics, the mass of the eccentrics, and/or the eccentric radii; but practical limits quickly are reached. Another approach adopted by the prior art was to increase the number of pairs of eccentrics, stacking them horizontally or vertically, or both, always with the aforesaid limiting factor in mind. Phrased differently, when prior art vibrodrivers were dimensionally enlarged for the purpose of increasing the net vertical vibratory force, the enlargement has taken place in the confined space between two parallel planes spaced apart by the dimension E and lying in planes XM. Examples of the various stackings are shown in FIGS. 6, 7, and 8.

In the example represented in FIG. 6, the axes of rotation of the eccentrics are in a common horizontal plane; in FIG. 7 the axes of rotation of the eccentrics are in two common horizontal planes and also are vertically stacked and in FIG. 8 the axes of rotation of the eccentrics are vertically stacked. The vibrodrivers III, IV and V of FIGS. 6, 7 and 8 are of the first arrangement above described, being sophisticated forms of the simple structure of the vibrodriver I shown in FIGS. 2 and 3. On these FIGURES, $A_1$..... designate the axes of rotation of the eccentrics, $B_1$..... the eccentrics and $R_1$..... represent the meshing gears of the eccentrics. The clamps are designated C; the drive motors have not been illustrated.

In the second arrangement of vibrodrivers, it is the effective diameters of the eccentrics (double their maximum radii) which are limited to the width E of the clamped sheet-pile. The previous solution to the problem of achieving a greater moment of eccentricity for this arrangement consisted in superimposing (stacking) several pairs of eccentrics vertically in an XM plane or extending the lengths of the eccentrics and, hence, the breadth of the vibrodriver. But these solutions became impractical when the vibrodriver had to provide a very high net unilinear vibratory force, because they unacceptably increased either the breadth or the height of the vibrodriver, or both.

The present invention solves the foregoing problem, essentially by using pairs of eccentrics, the portions or all of which, that are spaced away from the vicinity of the vertical plane of symmetry XM of the vibrodriver, have an effective width dimension in the Y direction greater than the effective width E of a sheet-pile P. In the case of eccentrics whose axis of rotation is parallel to the Y direction, the effective width is equal to the dimension of the eccentric in the Y direction. For eccentrics whose axis of rotation is perpendicular to the Y direction, the effective width is equal to double the maximum radii of the eccentric. Thus the width of the waist of the vibrodriver where it crosses above the sheet-pile is narrow, not exceeding E, and the laterally outwards ends of the breadth of the vibrodriver are of a width exceeding E. It will be observed that, due to the foregoing improvement, a vibrodriver, although supplying an increased net unilinear vibratory force, will lie close to a wall of sheet-piles, in effect hugging the same, and yet be clear of adjacent sheet-piles even when the sheet-pile engaged thereby is lower. This is accomplished by expanding the width of the vibrodriver at the portions thereof spaced from the line of sheet-piles in lieu of increasing the height and/or breadth, although either or both of these also can be enlarged if still further heightening of the net unilinear vibratory force is desired.

In the first arrangement of vibrodrivers embodying this invention it is the lengths of the eccentrics which are different, and in the second arrangement it is the effective diameters which are different, the lengths being greater farthest from the vertical plane XM of symmetry of the vibrodriver for the first arrangement and the effective diameters being greater furthest from said plane for the second arrangement.

FIGS. 9 and 10 illustrate a vibrodriver VI using the first arrangement and in accordance with the present invention. In vertical section (FIG. 9) this vibrodriver does not appear to differ from the prior art vibrodriver III shown in FIG. 6 inasmuch as it includes a breadth enlargement, the only enlargement that can be seen in FIG. 9, as well as a special width enlargement which only can be seen in FIG. 10. The vibrodriver VI constitutes two pairs of eccentrics, one being a pair of inner eccentrics 7 and 8 close to and on opposite sides of the central vertical plane XM of symmetry of the vibrodriver; these are the eccentrics which during utilization of the vibrodriver are closest to the wall of sheet-piles. The vibrodriver VI further includes a second pair of eccentrics 6 and 9 situated at the laterally outward ends of the vibrodriver and clear of the wall of sheet-piles. The eccentrics 6, 7, 8 and 9 have axes of rotation $1_{VI}$, $2_{VI}$, $3_{VI}$, $4_{VI}$, respectively, which are horizontal, parallel to one another and to the wall of sheet piles, and in a common horizontal plane.

Referring to FIG. 10, the length $e_1$, of the inner eccentrics 7 and 8 is less than the dimension E of the sheet-pile being sunk or extracted; in fact, since it is the width of the casing 5 at the waist of the vibrodriver which must not exceed E, and since the inner eccentrics are contained within the casing, the length of the inner eccentrics 7 and 8 must be even less than the width of the waist of the casing. The vibrodriver is secured to the sheet-pile P by a clamp C and is energized by a driving motor D.

However, pursuant to the present invention, nothing restricts the length $E_2$ of the outer eccentrics 6 and 9. Only a single pair of additional outer eccentrics 6 and 9 is, therefore, usually sufficient to obtain, with the inner eccentrics, the net unidirectional sinusoidal vibratory vertical force desired since their lengths can be made long enough to obtain a sufficient overall moment of eccentricity in spite of the short length of the inner eccentrics 7 and 8. $c_1$ through $c_4$ designate conventional ball or roller bearings for the ends of the eccentric axles.

The wasp-waist configuration of the vibrodriver VI in horizontal section is typical of vibrodrivers of the present invention.

According to a preferred embodiment of the invention, shown in partial horizontal section in FIG. 11, each of the longer outer eccentrics 6 and 9 of the vibrodriver VI of FIG. 10 are replaced by several shorter coaxial eccentrics 15, 16 and 17, identical, for example, to the inner eccentrics 7 and 8. This provides the advantage of using interchangeable parts. Another important advantage is the increase in the number of bearings, which results in a better distribution of the load.

FIG. 11 also shows a preferred configuration for mounting of the eccentrics on a common shaft. Each mounting includes three hollow sleeves 25, 26 and 27, which are interiorly slotted as shown in FIG. 12 to match a splined common shaft 28.

The eccentrics are fixed on the sleeves 25, 26 and 27 by keys 22, 23 and 24. These sleeves are supported by ball bearings, roller bearings or the like.

Figure 13:
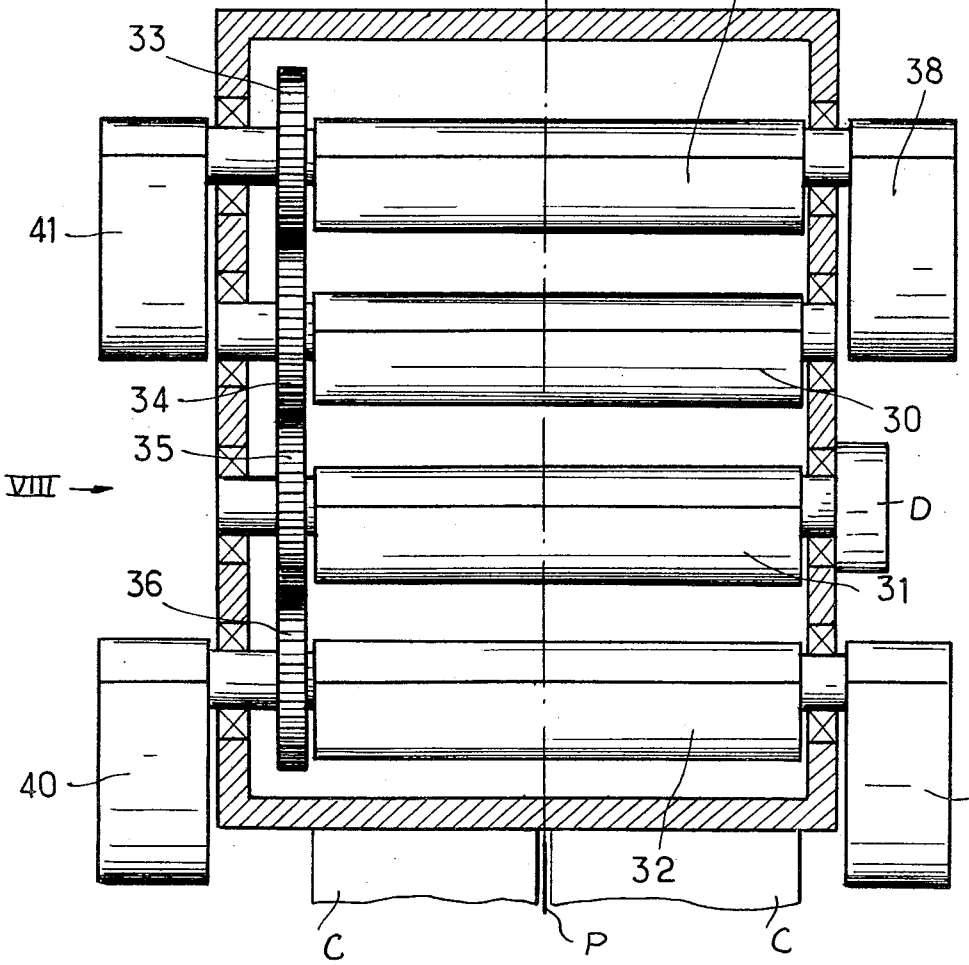
FIG. 13 is a schematic view in vertical section of the second type of vibrodriver embodying the present invention.

Referring now to FIG. 13, a vibrodriver VIII of the second type is illustrated, the same being modified to incorporate the present invention in order to increase the moment of eccentricity without increasing the height or breadth of the vibrodriver, by increasing the diameters of the eccentrics in zones spaced from the median plane 37, as shown for example in FIG. 13, which is an elevation view. The vibrodriver VIII includes four eccentrics 29, 30, 31 and 32 turning about horizontal axes, the rotational movements of the eccentrics being synchronized by gearings 33, 34, 35 and 36. The horizontal axes of rotation of the eccentrics 29, 30, 31 and 32 are parallel and situated in a vertical plane XM (FIG. 1) transverse and perpendicular to the vertical plane XM. At a distance from the axial plane 37 greater than the breadth of a sheet-pile P, additional eccentrics 38, 39, 40 and 41 of larger diameters of rotation have been added on the top and bottom axles carrying the eccentrics 29 and 32. The eccentrics 29 and 32 rotate in opposite directions at the same speeds and are identical, in order to cancel transverse vibrations and produce a sinusoidal vertical force. The same is true of the eccentrics 38 and 39 as well as the eccentrics 40 and 41 and the eccentrics 30 and 31.

Figure 14:
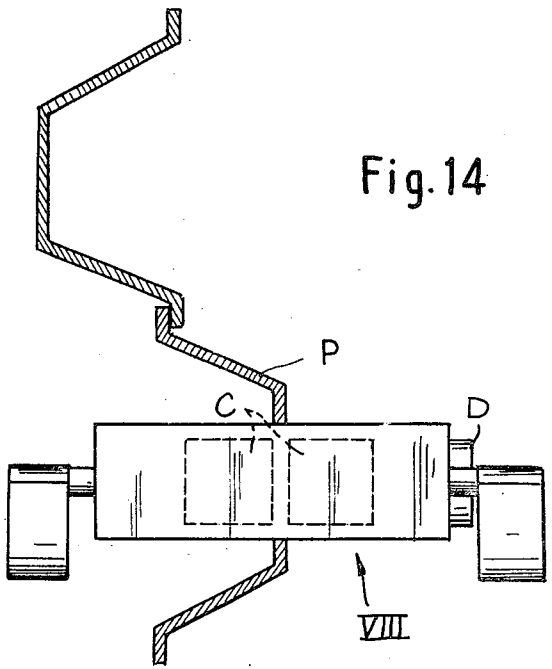
FIG. 14 is a schematic view in plan of the vibrodriver of FIG. 13 mounted on the upper end of a sheet-pile.

FIG. 14 illustrates the vibrodriver VIII mounted on a sheet-pile P with the aid of a clamp c. The drive motor is not illustrated.

The disposition of eccentrics in the present invention enables an increase in the power of the machinery, i.e. the moment of eccentricity, to be obtained while accommodating adjacent sheet-piles without risking the striking of these adjacent sheet-piles.

The improved vibrodrivers according to the invention may be of any known basic type e.g. as to the number of eccentrics involved, the driving of the eccentrics, their synchronization and their balancing in equilibrium for the cancellation of any non-vertical vibratory component by various means, the use of a plurality of motors for multiple drives, releasable clamps, etc., the main inventive concept being to provide, at a distance greater than the depth or thickness of the sheet-piles, eccentrics or parts of eccentrics of greater dimension than the clamped pile, thus enabling the creation of a powerful vibration or moment of eccentricity. More particularly, the arrangement of the dimensions of the eccentrics according to the invention can be combined with various improvements, specifically with regard to the number of eccentrics used to obtain a unidirectional vibration, or with regard to the relative rotational speeds of different pairs of eccentrics in the same vibrodriver, in proportion to other pairs of eccentrics.

Figure 15:
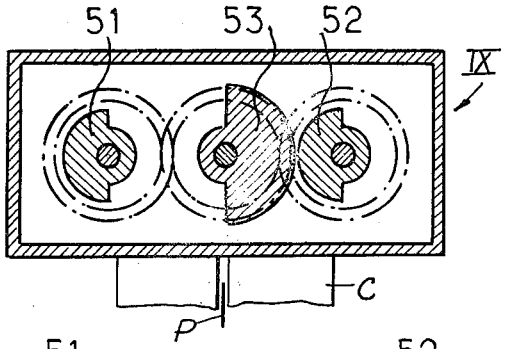
FIGS. 15 and 16 are schematic views in vertical and horizontal section, respectively, of the first type of vibrodriver with three conjointly balanced eccentrics constructed according to the present invention.
Figure 16:
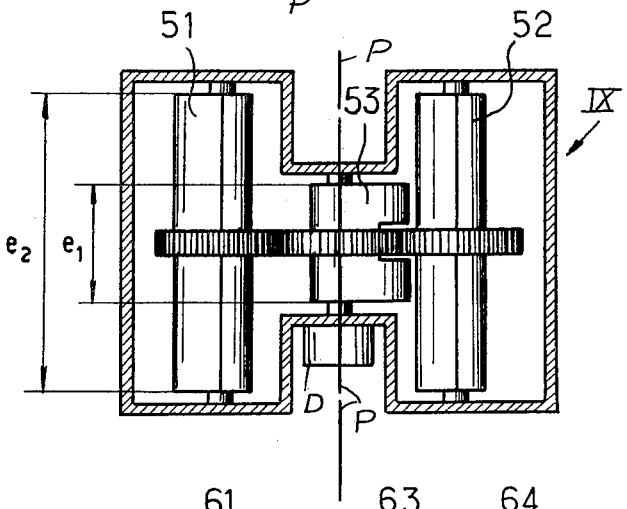

For example, FIGS. 15 and 16 represent a vibrodriver IX, of the first type in which there are three eccentrics 51, 52 and 53, the central eccentric 53 having an eccentric moment double that of each of the laterally outer eccentrics 51 and 52. This overall arrangement assures a unidirectional vibration, but, according to the principle of the present invention, the effective diameter of the central eccentric 53 is large enough so that each outer eccentric 51 and 52 is in an outer zone or region where the length of the eccentric does not interfere with and is not restricted by the maximum linear horizontal dimension of the clamped sheet-pile P, and the lateral eccentrics 51 and 52 can thus be of a length $e_2$ greater than the length $e_1$ of the central eccentric 53 (see FIG. 16). The transverse vibratory force generated by the central eccentric balances the transverse vibratory forces generated by the outer eccentrics; but the vertical vibratory forces of all these eccentrics are additive.

Figure 17:
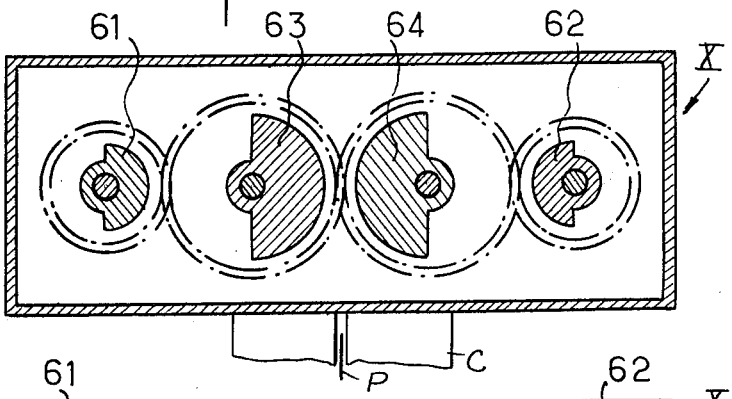
FIGS. 17 and 18 are schematic views in vertical and horizontal section, respectively, of a vibrodriver of the first type embodying the present invention and using pairs of eccentrics having different speeds of revolution.
Figure 18:
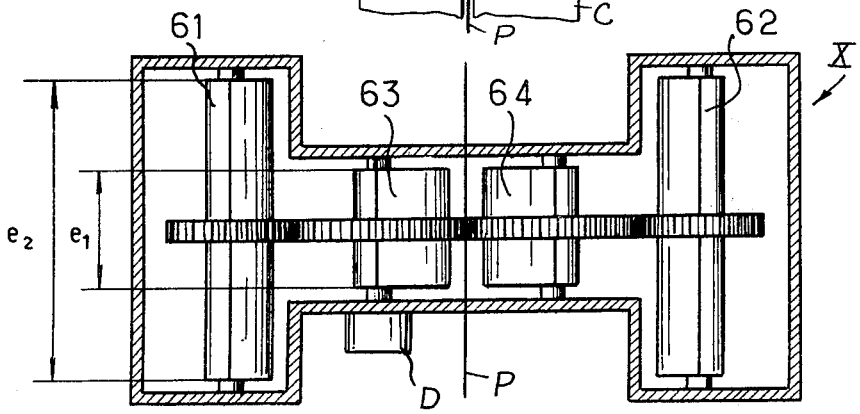

FIGS. 17 and 18 show schematically a vibrodriver X in which the speeds of rotation of the outer eccentrics 61 and 62 are different from those of the central eccentrics 63 and 64, this device creating, as a unit, a unidirectional vertical force the value of which is no longer a sinusoidal function of time, but the addition of two vertical sinusoidal forces of different frequencies, with the use of longer eccentrics for the outer pair 61 and 62 than the central pair 63 and 64, as indicated supra with reference to FIG. 10.

It thus will be seen that there are provided vibrodrivers which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. In combination, a vibrodriver for sinking or extracting a vertically elongated element of substantially uniform horizontal cross-section into or from the ground, said element being one of plural such elements arrayed in a line, said vibrodriver comprising at least three parallel eccentrics, means mounting said eccentrics for rotation about horizontal axes, at least two eccentrics or portion thereof being situated on a different sides of said element, means releasably clamping said vibrodriver on said element, so that said element is a clamped element, and means to rotate said eccentrics, whereby said clamped element is vibratorily sunk into or extracted from the ground, said clamped element having a maximum width along said line of elements, said at least two eccentrics or portion thereof having enlarged effective width dimensions exceeding the corresponding effective width dimension of a third of said eccentrics, said enlarged effective width dimensions being accommodated at zones spaced laterally from the clamped element, said vibrodriver being narrower than said clamped element at the zone adjacent said clamped element so that the vibrodriver has increased power due to the enlarged effective width dimensions yet will be clear of elements adjacent the clamped element.

2. The combination of claim 1, in which the axes of rotation of said plurality of eccentrics are parallel with said line, and in which a pair of outer eccentrics is provided that are longer than the width of the clamped element.

3. The combination of claim 2, in which each of the two outer eccentrics is composed of a plurality of coaxial separate sections.

4. The combination of claim 3, in which a pair of inner eccentrics is provided and in which each of the separate sections of the outer eccentrics are substantially the same as the inner eccentrics, the inner eccentrics being confined within the width of the clamped element.

5. The combination of claim 3, in which each of the separate sections is each mounted on a different sleeve, the sleeves of the different sections of an outer eccentric being synchronized and aligned by a solid shaft which extends through and rotates with all of the sleeves.

6. The combination of claim 5, in which the sleeves are internally axially grooved, and the solid shaft has an external axial projection received in said groove.

7. The combination of claim 1, in which the axes of rotation of the eccentrics are perpendicular to said line and the effective diameters of rotation of the at least two eccentrics at zones spaced from said line are greater than the width of the clamped element.

8. The combination of claim 7, in which the eccentrics at least two have outer parts with effective diameters of rotation greater than the width of the clamped element.

* * * * *